United States Patent [19]

Andersson

[11] 4,344,270

[45] Aug. 17, 1982

[54] METHOD AND APPARATUS FOR PACKAGING COMMODITIES

[75] Inventor: Sture Andersson, Boraas, Sweden

[73] Assignee: Tex Innovation AB, Vastrå Frolunda, Sweden

[21] Appl. No.: 274,738

[22] Filed: Jun. 18, 1981

Related U.S. Application Data

[63] Continuation of Ser. No. 73,340, Sep. 7, 1979, abandoned.

[30] Foreign Application Priority Data

Sep. 11, 1978 [CA] Canada ..... 311069

[51] Int. Cl.[3] ..... B65B 9/14; B65B 31/04

[52] U.S. Cl. ..... 53/511; 53/255; 53/257; 53/567

[58] Field of Search ..... 53/86, 261, 433, 434, 53/459, 469, 511, 512, 567, 257, 255

[56] References Cited

U.S. PATENT DOCUMENTS

| | | | |
|---|---|---|---|
| 2,590,327 | 3/1952 | Kay | 53/257 |
| 2,778,177 | 1/1957 | Mahaffy | 53/86 |
| 2,982,068 | 5/1961 | Pape | 53/567 |
| 3,511,021 | 5/1970 | Lyon | 53/512 |
| 3,557,526 | 1/1971 | Hartmann | 53/567 |
| 3,916,769 | 11/1975 | Turonen | 53/567 X |
| 4,110,954 | 9/1978 | Olsson | 53/511 X |

*Primary Examiner*—John Sipos

*Attorney, Agent, or Firm*—McFadden, Fincham & Co.

[57] ABSTRACT

There is provided an apparatus and method of packaging commodities in a flexible wrapper. The apparatus includes first and second stations with a wrapper engaging assembly moving between the first and second stations, wrapper cutting and sealing means which severs a bag length from a continuous roll of flexible material, a component for opening the open leading end of the wrapper at the second station, a funnel which is preferably expandable and which engages the open mouth of the wrapper so as to permit loading of the commodity into the wrapper, and a further assembly which seals the open mouth of the bag length, preferably under vacuum, by having a component preferably in the form of a pair of fingers which engages the mouth of the bag to place it under tension whereafter a sealing assembly seals the mouth of the bag to form an improved weld across the mouth of the bag.

4 Claims, 20 Drawing Figures

FIG. 14
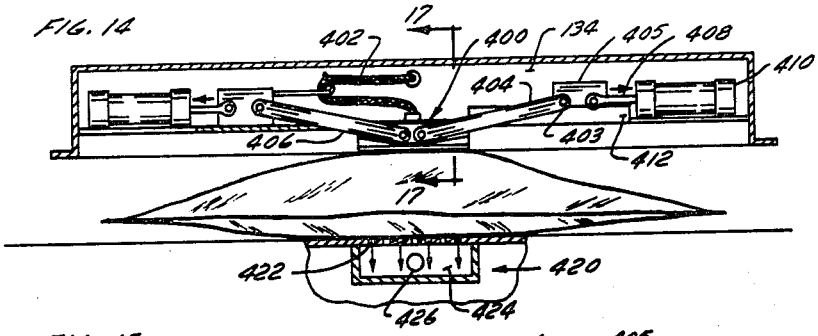
FIG. 15
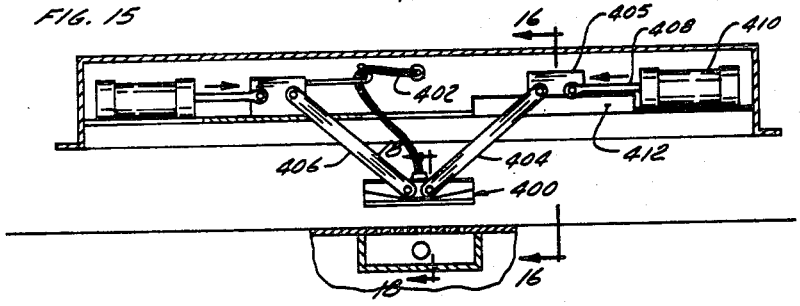
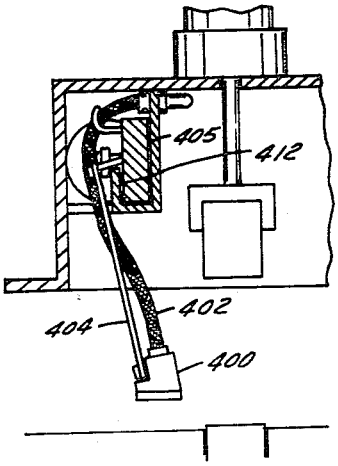
FIG. 16
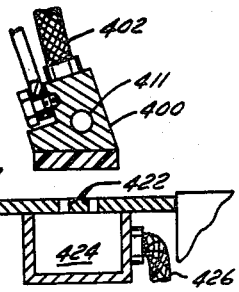
FIG. 18
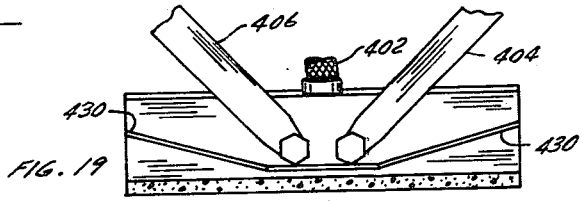
FIG. 19
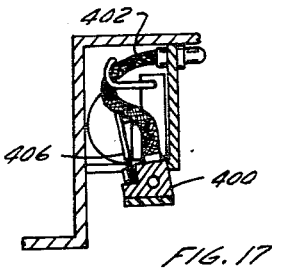
FIG. 17
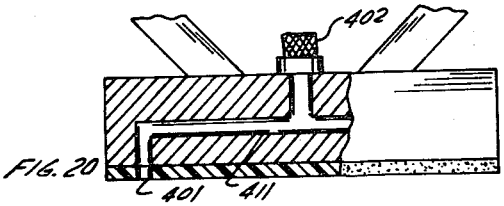
FIG. 20

METHOD AND APPARATUS FOR PACKAGING COMMODITIES

This is a continuation of application Ser. No. 073,340, filed Sept. 7, 1977, now abandoned.

This invention relates to the packaging of commodities.

More particularly, one aspect of this invention relates to a method of packaging commodities in a flexible wrapper; in another aspect of this invention, there is provided an apparatus for packaging a commodity in a flexible wrapper.

The method and apparatus of the present invention have particular application to the packaging of commodities, particularly compressible commodities, in flexible wrappers such as are made of a thermoplastic resin, e.g., polyethylene, polypropylene or the like.

The present invention is particularly applicable to the vacuum packaging of compressible commodities and as such, the present invention includes a vacuum packaging unit adapted to package a commodity to be wrapped, and which upon wrapping, is subsequently vacuum packaged in a flexible plastic wrapper.

Broadly, in accordance with the present invention, there is provided an apparatus for packaging a commodity comprising:

means for supplying a length of flexible sealable wrapper tubing, the tubing having an open leading end, a reciprocable movable wrapper engaging assembly movable and reciprocable between first and second stations, said assembly having means to engage a length of said tubing at said first station, means for advancing said wrapper engaging assembly between said first and second stations for returning the assembly to said second station, means at said second station for advancing a commodity filled wrapper from said station, wrapper severing and sealing means for sealing a bag length from said wrapper tubing and for severing the bag length to provide a sealed bag length having an open leading end, means for engaging and retaining the leading end of the tubing at said second station and to present an open mouth for insertion of a commodity into the tubing, means for discharging a severed and sealed bag length of material with a commodity therein from said second station, means for transporting or advancing the discharged commodity from said second station, vacuum packaging and sealing means, said vacuum packaging and sealing means comprising means for vacuum packaging said commodity in said wrapper, and means for retaining the open leading end of the wrapper under tension at said vacuum packaging and sealing means when said open leading end is sealed so as to provide an improved seal across the open leading end.

In greater detail of the invention, the means for supplying a length of flexible sealable wrapper tubing may be any suitable component for achieving this purpose and for feeding a single wrapper length of material to the movable wrapper engaging assembly. To this end, tubing will normally be provided in a roll form with a continuous length of tubing being drawn off the roll to the wrapper engaging assembly. At the initial start of the operation, the tubing has an open leading end, and the wrapper engaging assembly engages the length of wrapping material in tube form to subsequently advance a predetermined length of the tube material from the first station to a second station.

The invention may be employed with various bag sizes and to this end, the apparatus may include several rolls of continuous length of tubing having different widths. Thus, in operation, the bag size could be readily changed merely by having the wrapper engaging assembly engage the desired roll of tube material.

The movable wrapper engaging assembly can be composed of any suitable device for engaging the length of wrapping material—for example, the wrapping material since it is supplied in a lay-flat form, is normally presented from a roll of the same with a pair of opposed major faces so that the wrapper engaging assembly may comprise a pair of spaced apart suction cups engaging both the front and back (or upper and lower) panels of the tubing material at the second station. Other alternative arrangements may also be employed where, for example, gripping fingers may engage the length of wrapping material. Preferably, the movable wrapper assembly is movable as an entity between first and second stations or first and second positions, and accordingly, suitable drive means may be provided for advancing the wrapper assembly between the spaced apart stations. Such advancing means may be any suitable drive system such as is accomplished by providing a motor drive for the wrapper engaging assembly. The motor drive may advance the wrapper engaging assembly by means of a belt drive, chain drive or the like.

At the second station, in which the wrapper engaging assembly advances the flexible tubing from the first station, there is provided means for engaging and retaining the leading end of the tubing and for presenting an open mouth of the tubing at the second station for loading a commodity into the open-mouthed tubing. Such latter means may take various forms—e.g. a funnel diverging from the direction of travel of the tubing whereby the tubing, as it is advanced from the first station to the second station, will engage the narrower end of the funnel and expand to its full open mouth width by progressive movement along the funnel at the first station. Alternatively, other like components may be employed—e.g., further pairs or sets of suction cups may be provided at the second station for engaging the leading end of the tubing and for thereafter opening the tubing to a desired configuration of the commodity into the tubing.

A preferred form of the component comprises an expandable funnel, or alternatively, a funnel which diverges as outlined above. An expandable funnel can be employed by having a narrower end which is adapted to fit into the mouth of the leading portion of the bag and when the wrapper engaging assembly advances the leading portion of the bag into operative relationship with the funnel, the funnel may expand to tightly retain and open the mouth of the bag at the second station. The construction of an expandable funnel is known in the art.

When the leading portion of the wrapper is engaged by the funnel, control of the wrapper is then assumed by the funnel or other like component which serves to open the mouth of the bag to the desired degree. Optionally, additional control means can be employed in conjunction with the funnel—e.g., suction cups or the like to retain the leading portion of the wrapper in juxtaposition with the funnel. Thereafter, the wrapper engaging assembly is reciprocated back towards or to the first station. In one embodiment of the present invention, the wrapper engaging assembly may also mount the wrapper cutting and sealing means as sub-assemblies on the engaging assembly. A suitable severing means such as knife means, hot wires, etc., may be employed to cut a desired length of the wrapper to form a bag length from the roll of tubing; in a similar manner, the sealing means appropriate for the type of material being employed as a wrapper may be utilized for sealing the tubing—e.g., such sealing means may comprise a pair of spaced apart sealing bars, etc.

This invention therefore contemplates that the movement of the wrapper engaging assembly, with the severing and sealing means mounted on it, may be reciprocated from the second station towards the first to a predetermined length equal to the length desired to form the bag, and which of course, may vary depending on the type of commodity being packaged. But, preselected lengths of wrapping material may be sealed and severed by stopping movement of the cutting and sealing assemblies at the desired location as the wrapper engaging assembly returns from the second station to the first station.

It will also be appreciated that separate sealing and cutting assemblies may be employed rather than having them associated with the wrapper engaging assembly so that upon advancement of the wrapper from the first station to the second station, the cutting and sealing assemblies may then be actuated to independently seal and sever a predetermined bag length of material from the length of wrapping material.

In forming a bag length of material, the plastic is normally severed behind the sealing line so that upon severing the bag length of material from the continuous length of the wrapper, there is provided an open mouth (i.e. an open leading end) of the subsequent bag with a closed or bottom sealed end of the bag to be filled, or which has been filled depending on the sequence of filling.

When the mouth of the bag length has been opened at the second station, a commodity may be inserted into the bag for subsequent processing. To this end, the commodity may be manually inserted or alternatively, a feeding component for feeding a commodity into the bag may be provided. In terms of commodities, the present invention may package a wide range and variety of commodities. Typically, articles of clothing and in general, fabric materials may be packaged, but it will be understood that most any type of commodity that is required to be packaged in a flexible wrapper may be packaged by the method and apparatus of the present invention.

A particularly preferred form of the present invention involving advantageous features is the utilization of compressible commodities, when there is employed in conjunction with the above-described apparatus, a vacuum packaging unit. Such a unit may be of the type as described in U.S. Pat. No. 4,110,954.

When the commodity has been inserted into the wrapper, or even in modifications of the present invention after the bag length has been severed and sealed from the continuous length of the wrapping material, and following which the commodity is then inserted into the bag length, the means for engaging and retaining the leading end of the tubing at the second station may then release the leading end and permit the commodity filled package to be discharged from the second station. Preferably, the commodity is discharged onto a moving conveyor belt forming means for advancing a commodity from a second station to a subsequent processing station—e.g., a vacuum packaging and sealing operation. A most preferred form of the present invention comprises the utilization of a vacuum packaging and sealing chamber of the type described in the aforementioned U.S. patent, but in which there is provided means for retaining the open mouth portion of the bag length of wrapping material under tension so as to provide front and back (or top and bottom) panels of the bag wrapper in a lay-flat condition so that upon sealing in the sealing chamber, a proper seal is obtained.

To this end, there may be provided a pair of spaced apart movable fingers which will engage the open mouth portion of the bag when it is brought into proper position in the vacuum and sealing chamber; more particularly, in most cases, the commodity in the bag length of material will tend to retain the mouth of the bag in an open configuration and by utilizing a pair of spaced apart gripping fingers mounted in proximity to the location at which the bag is located in the vacuum packaging chamber, the fingers can be inserted into the bag mouth, subsequently expanded laterally to put the bag under tension and thereafter, the bag may be sealed after subjecting the bag to vacuum packaging conditions to evacuate the air therefrom.

The above-described components of the overall assemblies may be operated in time-related sequence either manually or automatically, by the use of appropriate initiation devices—e.g., limit switches, etc. In this manner, the apparatus of the present invention may be operated to advance a length of bag material from a supply thereof, following which the leading end of the bag material is opened, a commodity placed into the opened bag, the bag subsequently severed and sealed at the trailing end, subsequently discharged to the vacuum and sealing station while the operation can be repeated.

From the above description, it will also be seen that there is provided a corresponding method for packaging a commodity, using components such as the above-described components and in which a commodity is inserted into an opened bag after movement of a bag length of material from a first to a second station, the bag length is sealed and then severed, and the commodity inserted into the bag, whereafter the commodity filled bag is discharged from the second station and processed subsequently in a vacuum packaging and sealing step.

If desired, the bag need not be evacuated so that the method and apparatus of the present invention are equally applicable to non-vacuum packaged commodities.

Using the method and apparatus of the present invention, there is provided a simple and economical expedient for packaging commodities, particularly for vacuum packaging such commodities. Moreover, use of the present invention simplifies prior art operations and ensures that a steady and even seal is provided for the commodity during the last sealing step despite a commodity tending to distort the configuration of the bag.

For packaging materials, any suitable material may be employed—generally these are of a plastic nature although plastic backed foils, plastic backed papers, etc. can be used. The particular choice of material is dependent on the type of packaging required for any given purpose with plastic material such as polyethylene, polypropylene or laminates of the same or other different polymers being most commonly employed.

The invention thus permits the use of a tube of plastic material which is advantageous in that this is frequently the form in which the material is supplied. Each package may be used for several items depending on the size thereof. Furthermore, the packaging method described is particularly suitable for use with trays having the material thereon. To this end, trays containing the material to be packaged may be fed individually to the feeding mouth wherein the items on the trays are placed within the package by suitable means.

Various orientations of the apparatus may be employed. In one particularly preferred embodiment, the bag length of material is discharged from the second station in a direction 90° from the direction of movement of the movable wrapper engaging assembly between the first and second stations. However, other arrangements may be employed and to this end the assembly may be movable in the same direction as the material is discharged as will be described in greater detail hereinbelow.

Having thus generally described the invention, reference will now be made to the accompanying drawings, illustrating preferred embodiments and in which:

FIG. 14 is a detailed view of a portion of the vacuum packaging unit showing lifting of one surface of the tube;

FIG. 15 is a view similar to FIG. 14 showing movement of the arms of the vacuum unit;

FIG. 16 is a cross-sectional view taken along the lines XVI—XVI of FIG. 15;

FIG. 17 is a view taken along the lines XVII—XVII of FIG. 14;

FIG. 18 is a view taken along the lines XVIII—XVIII of FIG. 15;

FIG. 19 is a detailed view of the mounting of the arms carrying the vacuum unit; and FIG. 20 is a view, partially in section, of the vacuum connection.

Figure 1:
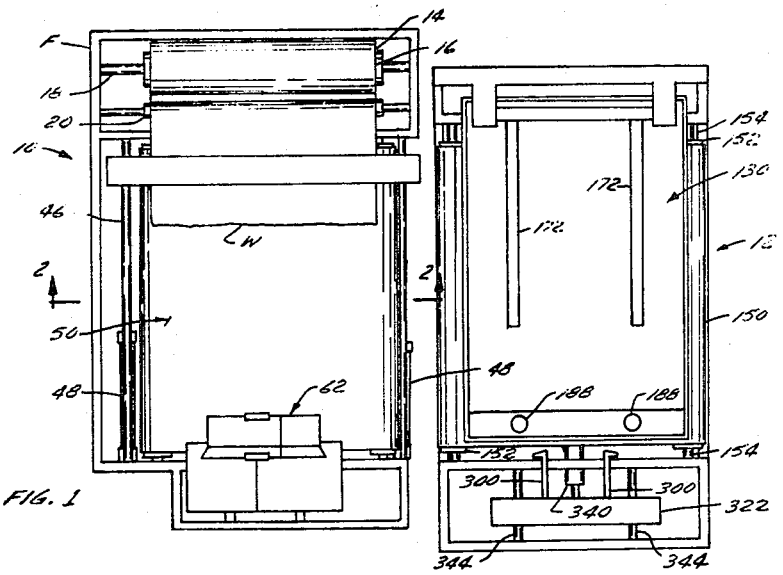
FIG. 1 is a top plan view of the bag filling and bottom sealing unit (shown on the left hand side) and of the vacuum chamber and sealing unit (shown on the right hand side)

Referring initially to FIG. 1, there is illustrated the combination of the packaging apparatus of the present invention in combination with the vacuum packaging and sealing unit, the former being indicated generally by reference numeral 10 and the latter by reference numeral 12. Referring to the packaging unit, there is provided a supply of flattened thermoplastic wrapping material in the form of an endless tube 14 mounted on a roll 16 and journalled by shaft 18 onto frame members F (and throughout the specification the reference letter "F" refers to frame members).

In the forward direction of advancement of the web of wrapping material, a guide roller 20 is provided over which the web W passes, where it is in engagement with a wrapper engaging assembly. The wrapper engaging assembly, shown in greater detail in FIG. 3, comprises a pair of suction heads 22 mounted in a spaced apart manner on a suitable frame which in turn is connected to the main frame of the apparatus. The upper suction head 22 is mounted on a plate 24 which in turn is connected to a piston rod 26 of a piston assembly 28 which is thereby effective to move the suction head 22 into and out of engagement with the lower suction head. Guide members 30 serve to guide the plate 24 in a vertical fashion.

Figure 3:
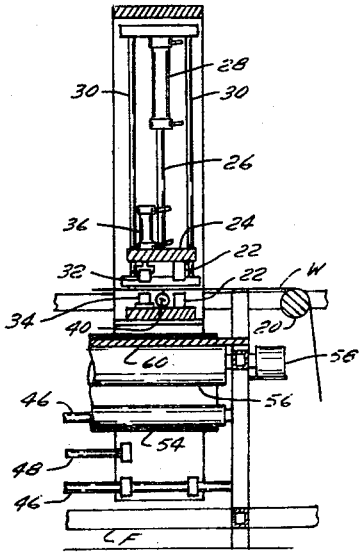
FIG. 3 is a section taken along the line III—III of FIG. 2.

As explained hereinbefore, the cutting and bag sealing means are preferably mounted on the wrapper engaging assembly and as will be seen from FIG. 3, there is provided a pair of sealing heads 32 and 34 mounted in a spaced apart manner; preferably, sealing head 32 is mounted on plate 24 with pneumatic cylinders 36, connected to the frame, being adapted to move the upper-sealing head 32 into engagement with the lower sealing head 34.

A knife assembly 40 is provided to sever a bag length of wrapping material from the web W, as described hereinafter in greater detail.

The wrapper engaging assembly is movable along guides 46 by suitable means, such as for example, with the use of a cylinder head 48 located on each side of the device. This assembly is movable between first and second stations—that is, as will be seen from FIG. 1, where the wrapping assembly is located, the first station represents the point at which the bag enters between the spaced apart vacuum heads and is effective to move it to a station where the bag is held by means of a funnel, to be described hereinafter in greater detail.

Figure 2:
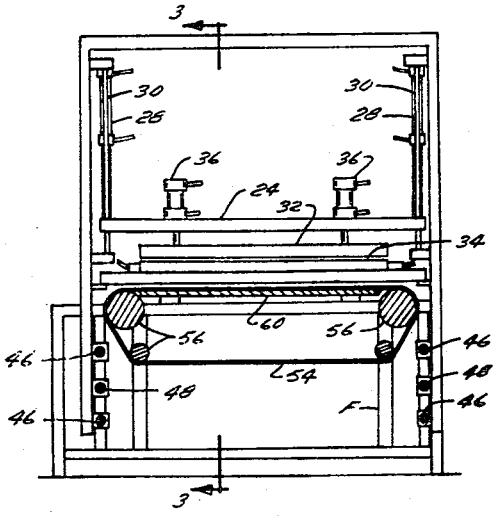
FIG. 2 is a section along the line II—II of FIG. 1 illustrating in greater detail the packaging station.

Between the first and second stations, there is provided a supporting bed indicated generally by reference numeral 50, and the construction of this is shown in greater detail in FIG. 2. The supporting bed actually comprises a movable belt 54, of an endless nature, rotating about rollers 56, one or more of which are driven by suitable drive means, e.g., motor 58. A rigid plate 60, connected to the frame, serves to support the upper portion of the belt 54. As viewed from FIG. 2, it will be noted that the belt 54 is movable from left to right, so as to transfer a wrapper stuffed with a commodity, to the vacuum packaging and sealing unit, as described hereinafter.

Figure 4:
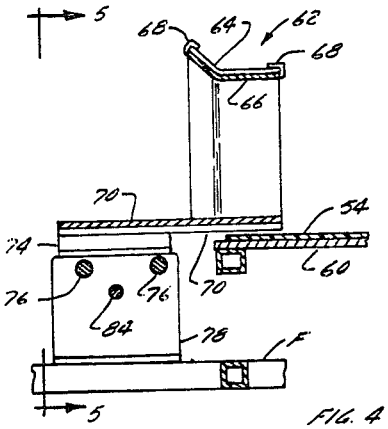
FIG. 4 is a section taken along the line IV—IV of FIG. 5 illustrating in greater detail a portion of the filling collar or funnel.
Figure 5:
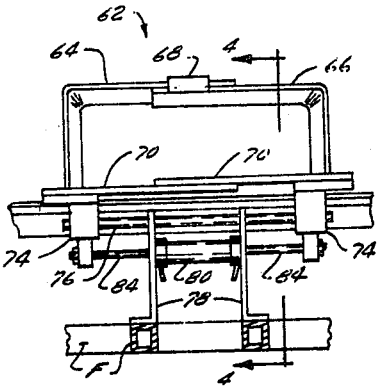
FIG. 5 is a section taken along the line V—V of FIG. 4.

Referring again to FIG. 1, in a preferred form, there is illustrated a funnel designated by reference numeral 62, generally, which funnel is used for the purpose of providing an entrance for loading a commodity into an open bag. Funnel 62 is of a type capable of expanding to accommodate different widths of a bag, and to this end, reference will be made to FIGS. 4 and 5 illustrating the funnel in greater detail.

The funnel comprises a pair of sections 64 and 66, which together, form a rectangularly shaped opening through which a commondity is fed. One or both of the upper sections of the funnel 62 are provided with guide brackets 68 to align the sections of the funnel; each section includes a bottom plate which overlaps the other or lies in juxtaposition with the same as indicated by reference numeral 70 in FIG. 5. As will be noted, the funnel has a tapering or narrower end in the direction of advancement of the bag material into the funnel—to be described hereinafter. Thus, there is a wider mouth portion as will be seen from FIG. 4. Each plate 70 is mounted on a bracket 74 which in turn, is mounted on a pair of guide rods 76. Guide rods 76 are mounted by means of brackets 78 to frame F of the apparatus. A hydraulic cylinder 80, of a double acting type, with a pair of piston rods 84, is connected to the brackets 78 in a rigid manner, while the piston rods 84 are mounted at their opposite end to brackets 74 which, as described above, carry the movable portions of the funnel whereby the funnel may be expanded or contracted to different sizes as desired.

Figure 6:
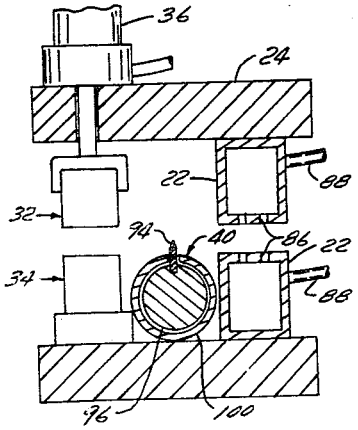
FIG. 6 is an enlarged sectional view of the sealing and severing means of the packaging station.
Figure 7:
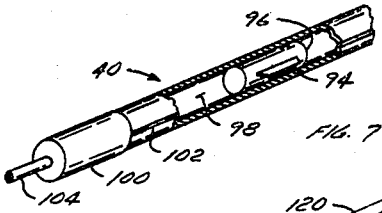
FIG. 7 is a partially exploded view of the cutting mechanism of FIG. 6.

Referring now to FIG. 6, the severing and sealing mechanism of the wrapper engaging assembly of FIG. 3 are illustrated in greater detail. It will be appreciated by those skilled in this art that the particular arrangement of the cutting and sealing means may be varied whereby, for example, the cutting and severing means may be located downstream of the direction of feeding of the web W from the vacuum heads 22—i.e., in a reverse arrangement to that illustrated. Each of the vacuum heads 22 is provided with a plurality of apertures 86 communicating with the interior of the vacuum head, and which interior in turn is connected by means of a conduit 88 to a vacuum pump (not shown). The severing knife, or cutting knife, as illustrated in greater detail in FIG. 7, is of the type known as an "Orega" as known to those skilled in the art. To this end, there is provided a free floating knife blade 94 mounted on a cylindrical member 96, which in turn slides in a chamber 98 of the cylinder 100. A slot 102 is provided in the cylinder 100 for the knife to project from and sever transversely of the web W as the knife slides from one side to the other. Actuation of the knife assembly is accomplished by means of a pneumatic system, with air conduit 104 being connected to chamber 100 at one end and a similar conduit (not shown) being connected to the other end of the chamber 102.

Figure 8:
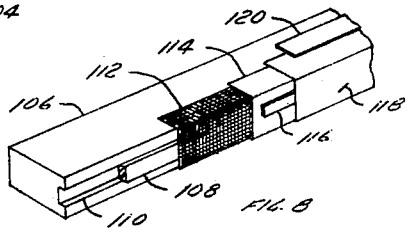
FIG. 8 is a detailed view of a typical sealing head used in the apparatus of FIG. 6.

The sealing heads illustrated in FIG. 8 in greater detail comprise a base 106 of solid material; there is provided a rubber insulator 108 located in a groove 110 of the housing 106; a wire mesh functioning in a protective manner (reference numeral 112) overlies the rubber strip 108; on top of the wire mesh 112 there is provided a backing member or layer 114 with an electrically conductive element 116 lying on top of layer 114. An outer covering 118 is provided and the whole assembly is held together by means of strip 120 securing the layer 118 to the housing 106.

Referring now to the vaccum unit 12, illustrated in greater detail in FIGS. 1 and 9 through 13, the vacuum unit comprises a generally rectangular shaped chamber 130 defined by a pair of spaced apart side walls 132 and a pair of spaced apart end walls 134 which mount a membrane of a flexible nature, and which membrane is indicated by reference numeral 136. The membrane 136 is free to move downwardly in the manner shown by the dotted lines in FIG. 10; the membrane is held in place by means of mounting blocks 138. A sealing gasket is provided about the lateral edges of the walls 132 and 134, and indicated by reference numeral 140. The bottom portion of the vacuum chamber is formed, in this instance, by means of a rotatable conveyor belt 150 rotating it about a plurality of rotatable rollers 152, at least one of which is driven by a motor (not shown) and each of which is journalled on a shaft 154 connected to a frame F. A rigid supporting plate is located beneath the lower surface of the upper portion of the belt 150, which plate is indicated by reference numeral 158. The belt is designed to rotate in the same direction of rotation as the belt 54 of the wrapper engaging assembly whereby a commodity filled wrapper may be transported by the rotation of belt 54 onto belt 150 and positioned in the vacuum packaging and sealing unit. If desired, the bottom portion of the vacuum chamber may be formed by a flexible membrane, or simply a rigid plate without a movable conveyor, depending on the type of commodity being packaged, etc.

Figure 9:
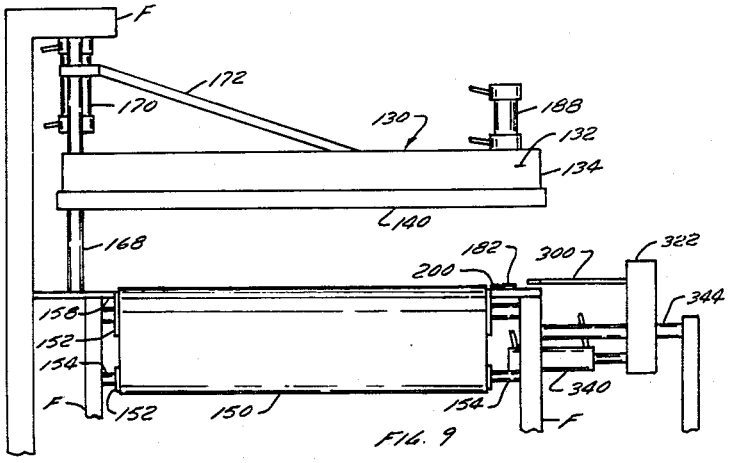
FIG. 9 is a side elevational view of the vacuum packaging and sealing unit.
Figure 10:
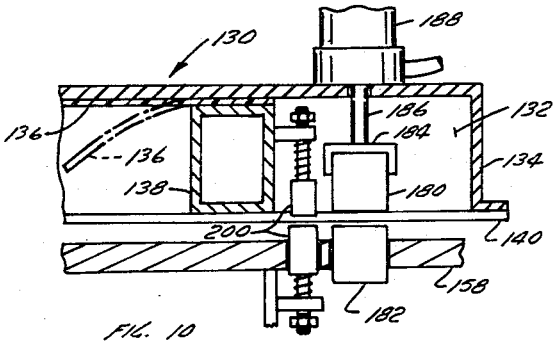
FIG. 10 is a detailed elevational view of the upper portion of the sealing unit in the vacuum chamber.
Figure 11:
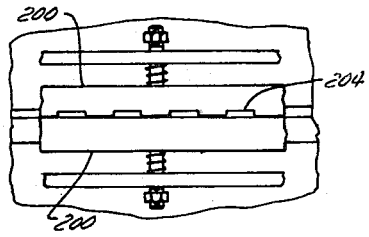
FIG. 11 is an enlarged view showing the closure for the sealing unit.

The upper portion of the vacuum chamber 130 is brought into engagement with the lower portion by the arrangement shown in FIG. 9. To this end, the upper portion is journalled on guide rods 168, whereby it is freely movable between upper and lower engaging positions with the lower portion of the vacuum chamber. A piston assembly 170 is fixedly secured to the upper portion 130 of the vacuum chamber, and is effective to raise and lower the same into and out of operative relationship with the lower portion of the vacuum chamber. Braces 172 aid in stabilizing the upper portion of the chamber 130.

Located within the upper portion of the vacuum chamber 130 is a sealing head 180, cooperating with an opposed sealing head 182 located in the lower portion of the vacuum chamber. Sealing head 180 is mounted by means of a bracket 184 to a piston rod 186 of a piston assembly 188, which is thereby effective to raise and lower the sealing head 180 into engagement with the sealing head 182, when the piston assembly 188 is actuated.

Air is evacuated from the vacuum chamber, when the two halves are brought into operative relationship. If desired, and optionally, a pair of gripping members may be employed to stabilize the commodity filled bag during a sealing operation but these are not essential. These gripping heads are indicated by reference numerals 200 and these may be spring loaded as illustrated to provide for different tensions. Apertures or recesses 204 in the upper gripping head 200 provide for the air escape from the vacuum chamber during evacuation of the air.

Figure 12:
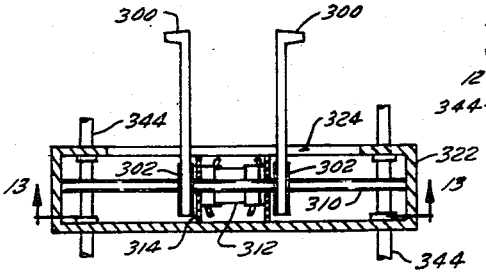
FIG. 12 is a cross sectional view of the mechanism for moving the fingers for retaining the bag in a flattened condition for sealing and is taken along the line XII—XII of FIG. 13.
Figure 13:
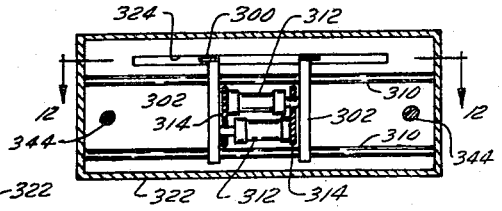
FIG. 13 is a section taken along the line XIII—XIII of FIG. 12.

In accordance with this invention, during the sealing of the front leading end of the bag, there is provided a device for retaining the open leading portion of the bag under tension during the sealing operation to provide an improved seal. More particularly, in accordance with this invention, such a device in a preferred form is illustrated in FIGS. 12 and 13 in particular and comprises a pair of spaced apart movable fingers 300, each finger being mounted on a supporting arm or bracket 302 with each bracket being connected to a piston assembly 304. The support members 302 are slidably mounted on guide rods 310. A piston assembly for each support plate is provided, as indicated by reference numeral 312.

This assembly 312 is mounted on a support plate 314, which extends between the side walls and is rigidly mounted thereto. Except for the fingers 300, this assembly is enclosed within a housing 322 with the fingers 300 projecting from a slot 324 in the housing.

Operating in conjunction with the means for retaining the wrapper under tension is a pneumatic cylinder 340 for moving the housing into and out of operative relationship; the housing sliding along guide rods 344 (FIG. 1). In this manner, the fingers may be brought into engagement position with the open mouth of the leading portion of a bag located in the vacuum chamber by actuation of the piston assembly 340, whereafter actuation of the piston assemblies 312 will cause lateral movement of the fingers into engagement with the walls of the bag wrapper so as to put them under tension and thereby flatten the mouth of the bag so as to permit sealing by the sealing bars 182 and 184.

The device also includes, in the illustrated embodiment, means for separating the opposed surfaces of the tube at the open mouth prior to insertion of the fingers into the bag wrapper. The device is suitably mounted on the interior of wall 134. The device is illustrated in FIGS. 14 through 21 which will now be referred to.

Referring initially to FIGS. 14 and 15, the device includes a vacuum head 400 which is operatively connected to a flexible conduit 402 in turn connected to a vacuum source (not shown). Vacuum head 400 is mounted on a pair of arms 404 and 406. As may be seen in FIG. 1, arm 404 in turn is mounted to a slidable block 405 which in turn is connected to piston 408 of cylinder 410. Thus, actuation of cylinder 410 causing movement of piston 408 and block 405 will in turn cause arm 404 to rotate about pin connection 403 to effect a downward movement of vacuum head 400. Block 405 may be slidable in a suitable channel 412 as shown in FIG. 16.

Operating in conjunction with moveable vacuum head 400 is a further vacuum gripping means generally designated by reference numeral 420. Vacuum gripping means 420 is adapted to grip and retain the lower side of the flexible tube. To this end, there is provided a plurality of apertures 422 communicating with the interior of vacuum chamber 424 with conduit 426 leading to the source of vacuum (not shown).

Vacuum head 400 has, on the wall on which arms 404 and 406 are mounted, a shoulder 430 as shown in detail in FIG. 19. As may be seen from FIG. 14, shoulder 430 is operative as a stop member or abutment to limit the upward movement of vacuum head 400.

Vacuum head 400 includes a plurality of apertures 401 therein, one of which is shown in FIG. 20. As may be seen, vacuum conduit 402 is suitably connected to interior conduits 411 such that the vacuum may be applied through apertures 401.

In operation, a web W of tubular plastic material, such as polyethylene or the like, is initially placed between the vacuum or suction heads 22 of the wrapper engaging assembly, at start-up. Following start-up, the drive means (piston rods 48) will move the wrapper engaging assembly from the first station (at the point where it engages the leading end of a web) to a second station, at which point the leading end of the wrapper is placed about the funnel 62. Prior to or during movement of the wrapper assembly from the first to the second station, the piston rod 28 is actuated to open the mouth of the leading end of the bag so as to permit it to surround the periphery of the funnel 62—or in other words, the funnel 62 is permitted to enter into the open mouthed portion of the wrapper as the wrapper advances to the second station. Thereafter, the respective portions of the funnel 62 are opened by means of piston assembly 80 to engage the leading mouth portion of the wrapper. At this point, the funnel then takes control of the tube. A sensing device may be provided for determining when the tube is placed under control of the expanded funnel, and thereafter, the wrapper engaging assembly is returned to the first station after releasing the vacuum from the suction heads 22. The wrapper engaging assembly can, as previously described, move back a predetermined distance, corresponding to the length of the bag desired, whereafter, the cutting blade 94 and the sealing heads 32 and 34 are actuated to seal and sever an appropriate bag length. Prior to or during this latter operation, a commodity may be fed in through funnel 62 and placed in the bag. This may be accomplished manually or through an automatic feeding machine (not shown). In this respect, the wrapper engaging assembly, and more specifically, the vacuum heads 22 may be operated in such a manner so as to still engage the flattened sheets of the web while the funnel retains control of the leading portion of the wrapper and after the commodity has been inserted into the wrapper, the drive means for the wrapper engaging assembly may be "jerked" backwards to release the weld from the sealing heads 32 and 34, whereafter the wrapper engaging assembly then returns to its original position at the first station.

The funnel is then closed in or returns to its original position whereby the open mouthed portion of the now filled plastic bag is no longer retained by the funnel and the charged plastic tube is now free to be moved by the conveyor belt 54, in conjunction with conveyor belt 150, into the vacuum and sealing assembly 62.

Subsequently, vacuum head 400 is lowered into juxtaposition with the upper surface of the bag. The vacuum circuits are then actuated and vacuum head 400 lifted so that the mouth of the bag is open as shown in FIG. 14. The lower portion of the bag is retained in position due to the lower vacuum. Subsequently, upon actuation of cylinder 340, the fingers 300 are brought into the open mouth of the bag by movement of the housing 322. Thereafter, actuation of cylinders 312 will cause lateral movement of the fingers 300 to bring the same into engagement with the sides of the bag; pressure sensors (not shown) connected or associated with the fingers 300, can be utilized to place a predetermined tension on the mouth of the bag to cause the desired degree of flatness of the bag prior to vacuum packaging and sealing. As will be appreciated, the fingers 300 are inserted into the mouth of the bag a distance less than the point at which the sealing heads are adapted to seal the bag across the mouth thereof so as to avoid interference with the sealing operation. If desired, following sealing, and removal of the fingers thereafter, any excess material may be severed by means of a cutting assembly (not shown).

During the sealing operation, following stretching of the bag, the upper portion of the vacuum chamber is lowered into sealing engagement with the lower portion of the vacuum chamber and a vacuum created so as to evacuate the air with the membrane 136 serving to evacuate the air in the manner described in the aforementioned U.S. patent. In this manner, utilizing compressible commodities, the commodity may be compressed and the air evacuated, following which the sealing operation takes place. The fingers are then removed and the bag subsequently discharged from the vacuum and sealing station 12 by means of the conveyor 150.

It will be appreciated from the above-described embodiments that various modifications can be made to the invention without departing from the spirit and scope of the same.

The apparatus has substantial advantages for the packaging of various commodities. Thus, as will be appreciated, different bag sizes may be employed merely by mounting a plurality of tubes of varying widths. As may be seen, changeover to any desired bag width would be simple for the operator of the machine. Furthermore, the length of the bag may easily be varied by the distance the wrapping assembly moves. One or more items may be fed to the funnel for wrapping and if desired, a tray arrangement may be employed.

It will be understood that various changes and modifications may be made to the above-described embodiments without departing from the spirit and scope of the invention. For example, the wrapping assembly, in certain instances, may desirably be mounted between belts 130 and 50 and, as seen from FIG. 1, be movable along suitable guide rails from a first station intermediate belts 130 and 50 to a second station at the left-hand extremity of belt 50. In such an embodiment, a lower knife and sealing assembly would be reciprocally mounted between belts 130 and 50 such that it may be raised for the desired cutting and sealing operation and lowered during passage of the wrapped commodity to the vacuum station. Funnel 62 would then be mounted on the left-hand side of belt 50 as seen from FIG. 1.

I claim:

1. Apparatus for packaging and sealing a commodity in a bag comprising: a packaging unit and a vacuum packaging and sealing unit; the packaging unit having a support bed, the support bed comprising an endless belt; means on one side of the belt for storing a supply of tubing; a commodity loading funnel fixed on the other side of the belt, reciprocating means for opening up the leading end of the tubing and for drawing a length of the tubing in one direction across the belt from the one side to the other side and over the funnel so that a commodity can be loaded into the tubing on the belt through the funnel, the reciprocating means having means thereon to cut and seal the length of tubing at the one side of the belt to form an open-mouth bag, means for moving the belt in a direction transverse to the one direction to laterally transfer the commodity loaded bag from the packaging unit to the vacuum packaging and sealing unit, the vacuum packaging and sealing unit having a support bed to receive the commodity loaded bag, means on the packaging and sealing unit movable in one direction for use in opening up the mouth of the bag, separate means movable in a second direction to enter the open mouth of the bag and to tension it, and means to vacuum seal the bag.

2. Apparatus as claimed in claim 1 wherein the funnel is adjustable as to size.

3. Apparatus as claimed in claim 1 wherein the support bed in the vacuum packaging and sealing unit includes a conveyor belt, movable away from the packaging unit.

4. Apparatus as claimed in claim 1 wherein the means for opening up the mouth of the bag comprises a vacuum head movable between a raised, stored position and a lowered operative position, and a vacuum means in the sealing unit support bed.

* * * * *